United States Patent [19]

Schnell

[11] Patent Number: 4,500,044

[45] Date of Patent: Feb. 19, 1985

[54] APPARATUS FOR WINDING BOLTS OF CLOTH OR THE LIKE

[76] Inventor: Heinrich Schnell, Schwanheimerstr. 78a, D-6930 Eberbach, Fed. Rep. of Germany

[21] Appl. No.: 521,505

[22] Filed: Aug. 8, 1983

[30] Foreign Application Priority Data

Jan. 25, 1983 [DE] Fed. Rep. of Germany ..... 3302291
Aug. 7, 1983 [DE] Fed. Rep. of Germany ..... 3229506

[51] Int. Cl.[3] ..... B65H 19/26; B65H 19/28

[52] U.S. Cl. ..... 242/56 A; 242/61; 242/62; 242/64; 242/68.4; 242/76

[58] Field of Search ..... 242/56 A, 64, 68.4, 242/68.3, 68.1, 61, 62, 76

[56] References Cited

U.S. PATENT DOCUMENTS

| | | | |
|---|---|---|---|
| 1,390,957 | 9/1921 | Hosch | 242/61 |
| 1,503,858 | 8/1924 | Steiner | 242/62 X |
| 1,866,471 | 7/1932 | Kiehn | 242/62 |
| 3,497,150 | 2/1970 | Harmon | 242/56 A |
| 3,866,325 | 2/1975 | Wynn | 242/68.4 X |
| 3,881,665 | 5/1975 | Leloux | 242/56 A X |

FOREIGN PATENT DOCUMENTS

| | | | |
|---|---|---|---|
| 2317325 | 2/1977 | Fed. Rep. of Germany . | |
| 480623 | 10/1975 | U.S.S.R. | 242/68.4 |

*Primary Examiner*—John M. Jillions
*Attorney, Agent, or Firm*—Peter K. Kontler

[57] ABSTRACT

Apparatus for converting an intermittently running web into a series of discrete bolts by winding the web onto flat strip-shaped cores has two parallel winding devices each of which has two spaced-apart coaxial rotary bolt holders with jaws which can engage the marginal portions of the web as well as the end portions of a core before the respective bolt holders are set in rotary motion. Each winding device is preceded by a bolt deflecting device which prevents fluttering of the web during winding. The winding devices and the deflecting devices are mounted on two brackets which are indexible through 180° about a fixed axis to move one of the winding devices to an operative position while the other winding device is held in a position of readiness and vice versa. The web can consist of a single layer or of two or more overlapping layers.

10 Claims, 19 Drawing Figures

APPARATUS FOR WINDING BOLTS OF CLOTH OR THE LIKE

BACKGROUND OF THE INVENTION

The present invention relates to apparatus for converting a continuous running web of textile material or the like into a succession of discrete rolls or bolts. More particularly, the invention relates to improvements in bolt forming or winding apparatus of the type wherein a first winding device is active while a second winding device is held in a position of readiness and the second winding device is activated when the first winding device completes the making of a bolt.

German Auslegeschrift No. 2,317,325 discloses a winding apparatus wherein each of the two winding devices comprises two bolt holders which are disposed at the opposite sides of the path of movement of the running web. Each of the two winding devices is preceded by a web deflecting device, and the two winding devices are mounted on a support which is indexed through 180 degrees whenever a winding device accumulates a fully grown bolt of convoluted web material. Indexing of the support through 180 degrees entails a movement of the winding device which is about to start the making of a bolt to the position previously occupied by the other winding device and vice versa. Such apparatus further comprises a cutter which is actuatable to sever the web between the two winding devices when one of these devices completes the making of a fully grown bolt. The positioning of deflecting devices relative to the associated winding devices is selected in such a way that each deflecting device contacts the web during each stage of accumulation of a bolt on the associated winding device and that the web does not come in contact with any other part or parts in the region between the deflecting device and the associated winding device. The apparatus which is disclosed in this German publication is used for the winding of foils consisting of synthetic plastic material Each bolt is formed by winding the foil around a hollow cylindrical core, and the end portions of the core are engaged by the bolt holders of the respective winding device while the latter rotates to wind the foil around the core. A roller is provided to bias the foil against the core during the initial stage of the making of a bolt to thus ensure that the leader of the foil cannot slip with reference to the core. It has been found that the utilization of such biasing rollers is undesirable in apparatus which are used to wind webs of textile material, especially webs which contain several overlapping layers of textile material, because the rollers enhance the tendency of the textile material to crinkle, i.e., to develop folds which are hard to remove if the textile material remains in the form of a bolt for extended periods of time. Moreover, the development of pronounced folds is likely to cause the dimensions of the fully grown bolt of textile material to depart from optimum or expected dimensions; this can create problems in connection with storage of such bolts.

OBJECTS AND SUMMARY OF THE INVENTION

An object of the invention is to provide a novel and improved apparatus which is constructed and assembled in such a way that it is less likely to cause the webs of a textile or other material to develop transverse and/or longitudinally extending folds during conversion of such webs into bolts rolls, or analogous configurations.

Another object of the invention is to provide an apparatus which can be used with advantage for the making of bolts wherein a web of textile or other sheet-like material is convoluted around cylindrical or flat strip-shaped cores and wherein the configuration of the selected core does not affect the ability of the apparatus to prevent the development of folds.

A further object of the invention is to provide novel and improved winding devices for use in an apparatus of the above outlined character.

An additional object of the invention is to provide novel and improved web deflecting or guiding devices for use in the above outlined apparatus.

Still another object of the invention is to provide an apparatus which can form bolts with a minimum of interruption between the making of successive bolts.

A further object of the invention is to provide the apparatus with novel and improved means for spreading the running web during travel of successive increments of the web toward the winding station.

Still another object of the invention is to provide novel and improved means for converting the apparatus for the treatment of wide or narrow webs.

A further object of the invention is to provide an apparatus which can treat single-layer or multi-layer webs with the same degree of accuracy.

Another object of the invention is to provide a novel and improved method of converting a continuous running web into a series of rolls or bolts in a time-saving operation and with resort to a relatively simple apparatus.

The invention resides in the provision of an apparatus for converting a running web (e.g., a single layer or two or more overlapping layers of cloth or other textile material) into a series of discrete bolts (with or without cores). The apparatus comprises a source of running web, a support which is indexible about a fixed axis (preferably about a horizontal axis) between first and second positions at 180° with reference to one another, first and second winding devices and first and second deflecting devices mounted on and indexible with the support so that the first winding device assumes an operative position in the first position of the support and receives from the source successive increments of the running web which is maintained in a predetermined path by the first deflecting device while the second winding device and the second deflecting device assume positions of readiness and the second winding device assumes an operative position in the second position of the support and receives from the source successive increments of the running web which is maintained in the predetermined path by the second deflecting device while the first winding device and the first deflecting device assume positions of readiness (the path extends through the winding device which is held in the position of readiness), and means for severing the web intermediate the two winding devices upon completed conversion of a length of web into a bolt on the winding device which is held in the operative position. The winding devices are rotatable about axes which are parallel to the fixed axis of the support, and each winding device comprises a pair of coaxial rotary bolt holders disposed at the opposite sides of the path for the web and having tongs movable axially with portions of the corresponding bolt holders between retracted positions of disengagement from and extended positions of engagement with the adjacent marginal portions of the web in the path. Each bolt holder further comprises detent means serving to maintain the respective tongs in a predetermined angular position in the retracted position of the tongs.

The apparatus preferably comprises a discrete prime mover for each of the bolt holders, and these prime movers rotate the respective bolt holders about the axes of the corresponding winding devices. Such apparatus further comprises means for synchronizing the movements of the bolt holders of each of the winding devices. The support preferably comprises two spaced-apart brackets which are mounted on and are indexible (e.g., by hand) with or relative to a common shaft. Each bracket supports one bolt holder of each winding device and the corresponding prime mover.

Each bolt holder further comprises a housing which is mounted on the support, and the aforementioned portion of each bolt holder comprises or constitutes a winding head which supports the respective tongs. The winding heads are rotatable about the axes of the respective winding devices and are movable axially with reference to the corresponding housings between the retracted and extended positions. Each winding head includes a wall which is adjacent to the respective side of the path for the web, and each of the tongs has jaws extending beyond the respective wall toward the path. Still further, each winding head includes spring-biased actuating means in the form of pivotable levers or the like for opening and closing the jaws of the respective tongs when the winding heads respectively assume their extended and retracted positions.

Each bolt holder preferably further comprises an elongated hollow bearing member in the form of a pipe or the like one end portion of which is connected with the corresponding winding head and which is rotatable about the axis of the respective winding device as well as movable axially relative to the support, a coupling element which is rotatably and axially movably mounted in the respective bearing member, motor means for moving the bearing member axially with reference to the respective housing, and a spring-loaded biasing member including an elongated carrier which is longitudinally movably but non-rotatably connected with the corresponding coupling element. Each coupling element is provided with cam means serving to close the respective tongs in response to axial movement of the coupling element toward the path for the web.

The apparatus preferably further comprises means for supplying cores (e.g., cores in the form of flat elongated strips or planks) between the bolt holders of the winding device which is held in the position of readiness. Each bolt holder of such apparatus preferably further comprises the aforementioned biasing member which is movable between an operative position adjacent to one side of the core between the bolt holders of the respective winding device and an operative position, and each of the tongs is arranged to urge the respective biasing member against the core in the operative position of the biasing member. The biasing members of each pair of coaxial bolt holders are mirror symmetrical to one another with reference to a plane which is disposed midway between the bolt holders of the two winding devices, and each biasing member overlies a portion of the path for the web when it assumes the operative position. Each biasing member can comprise a web which serves to move the respective winding head axially to the retracted position in response to movement of the biasing member from its operative position. Furthermore, each biasing member can comprise a pair of legs which are reciprocable in the respective winding head, and at least one of these legs is provided with abutment means serving to entrain the respective winding head to the extended position in response to movement of the biasing member to its operative position.

The aforementioned detent means are designed to hold each winding head against angular movement relative to the housing of the respective bolt holder in response to movement of the winding head to its retracted position whereby the winding head is maintained in a predetermined angular position to hold the respective tongs in a predetermined orientation with reference to the web in the path.

Each deflecting device can be provided with a convex web-contacting surface and can comprise web-spreading ribs which are provided on the convex surface. Such ribs preferably form two groups of spaced-apart ribs which are disposed at the opposite sides of a plane that extends midway between the bolt holders of the two winding devices. The ribs of the two groups are inclined in opposite directions with reference to such plane and the thickness of each rib is preferably less than ten percent of the mutual spacing of neighboring ribs in the respective group.

The means for supplying cores to the winding device which is held in the position of readiness can comprise a magazine for a supply of cores and means for transferring a core from the magazine onto the web portion extending between the bolt holders of the winding device which is held in the position of readiness.

If the support includes two spaced-apart brackets each of which supports one bolt holder of each winding device, the apparatus preferably further comprises means for moving the brackets toward or away from each other axially of the winding devices. The deflecting devices are preferably adjustable (of variable length) and their end portions are preferably secured to the two brackets so that the length of each deflecting device changes automatically in response to movement of the two brackets relative to one another.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
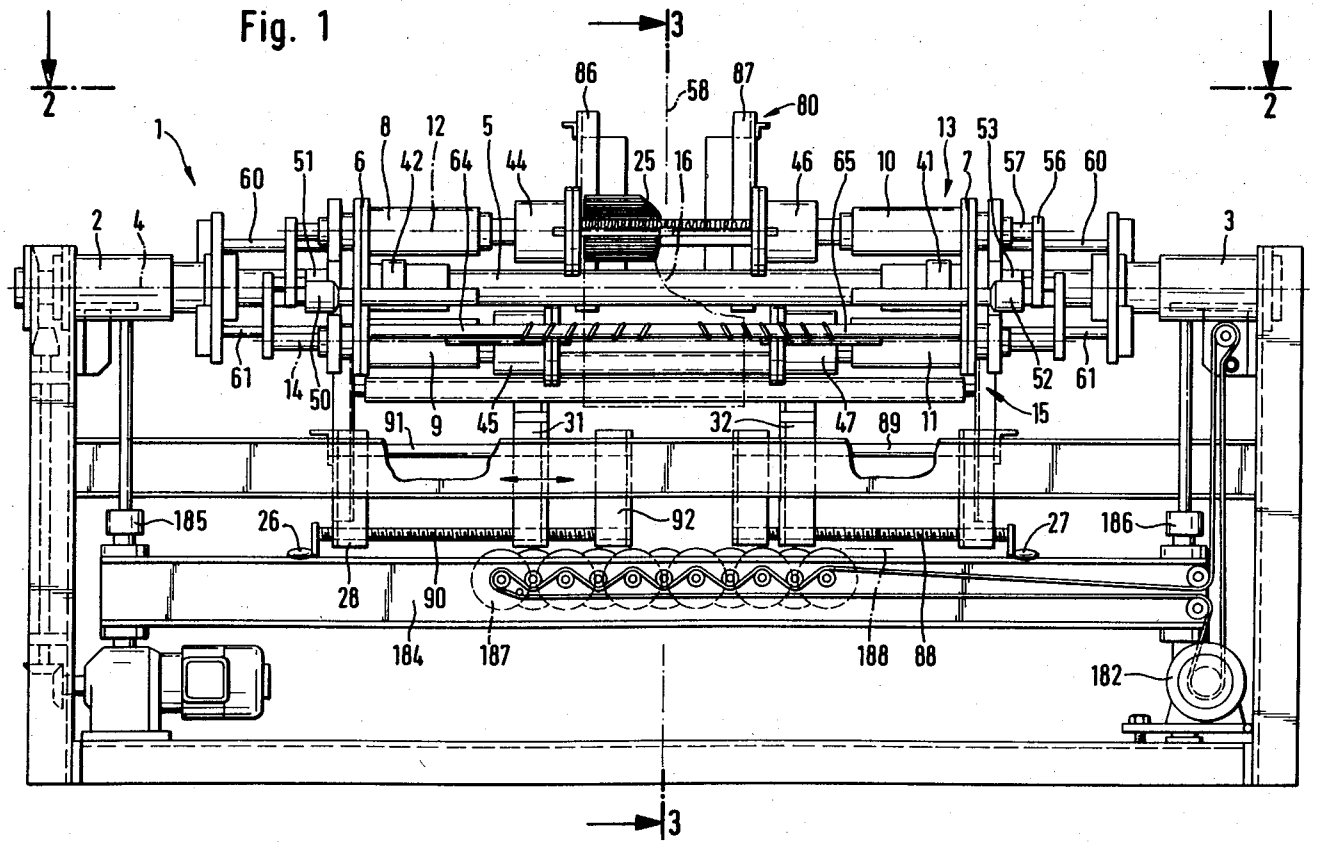
FIG. 1 is a front elevational view (as seen in the direction of arrows from the line 3—3 of FIG. 3) of a winding apparatus which embodies one form of the invention.
Figure 2:
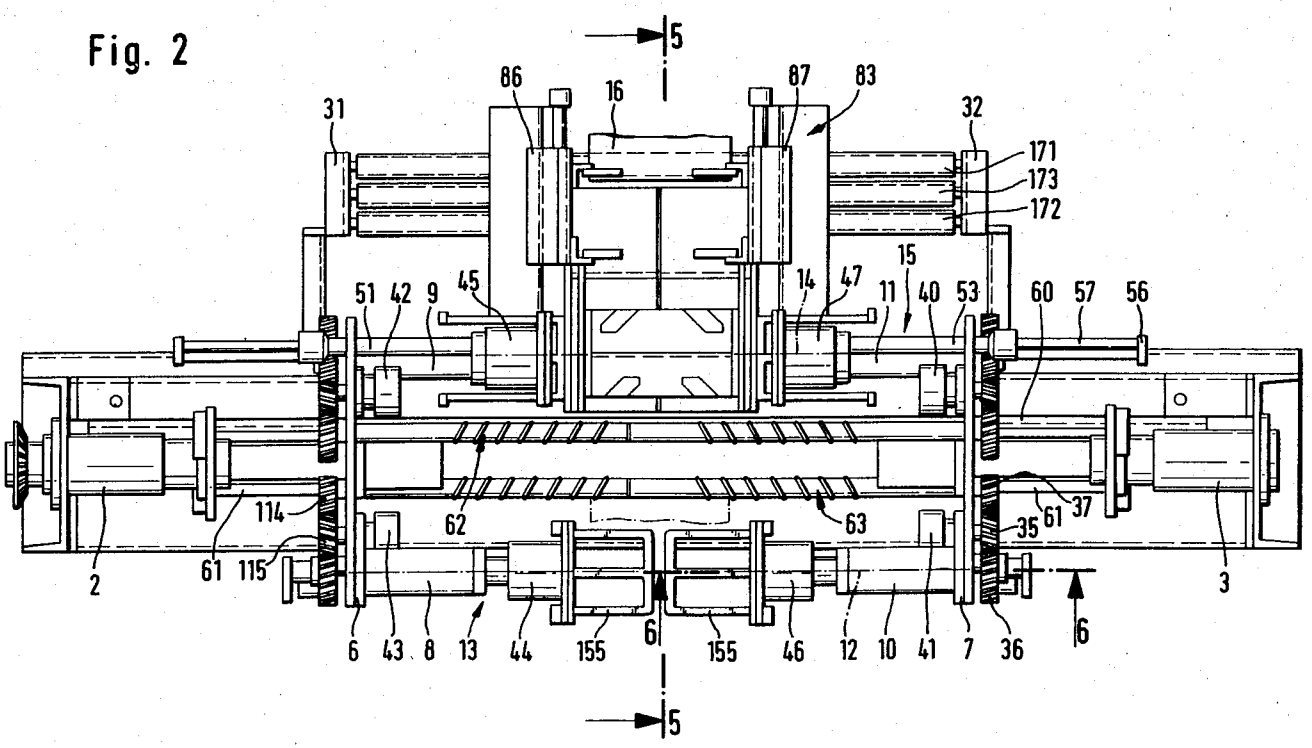
FIG. 2 is a plan view as seen in the direction of arrows from the line 2—2 of FIG. 1.
Figure 3:
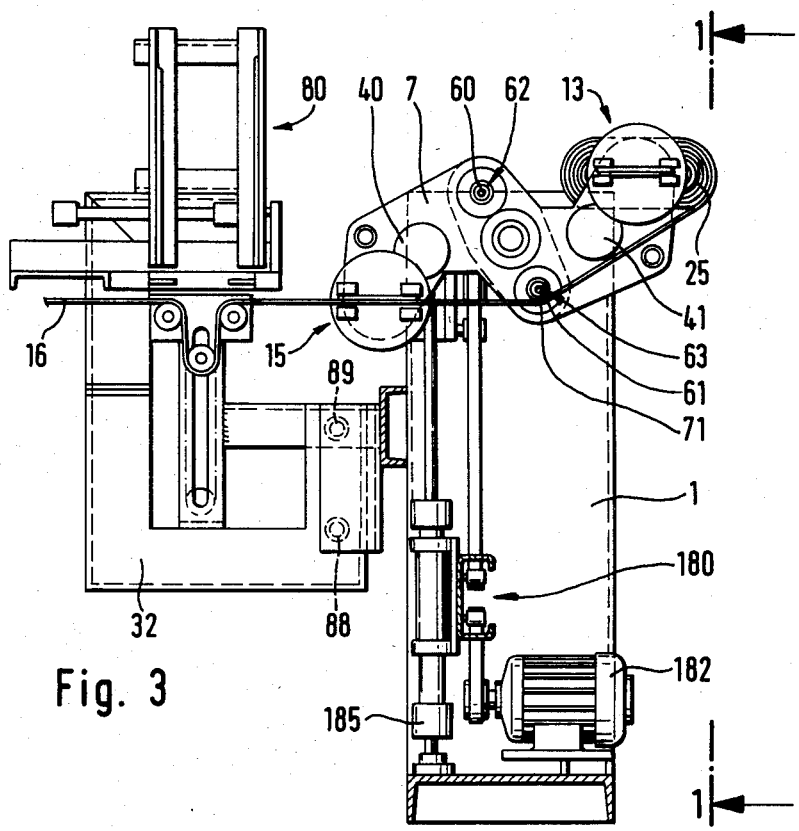
FIG. 3 is a transverse vertical sectional view as seen in the direction of arrows from the line 3—3 of FIG. 1.

Referring to the drawing in detail, and first to FIGS. 1 to 3, there is shown a winding or convoluting apparatus which comprises a frame 1 supporting two coaxial bearings 2 and 3 for a horizontal indexing shaft 5 whose axis is indicated at 4. The shaft 5 carries a support including two brackets 6 and 7 which share its rotary movements but are shiftable in parallelism with the axis 4. The means for shifting the brackets 6, 7 axially of the shaft 5 comprises discrete wheels each of which can be actuated by hand to rotate a pinion in mesh with a toothed rack which is secured to or forms part of the shaft 5. For the sake of clarity, FIG. 5*a* merely shows the wheel 38 for the bracket 7; the pinion (not specifically shown) which is rotatable by the wheel 38 meshes with a toothed rack 39 on the shaft 5. The toothed racks 39 further serve to prevent rotation of the respective brackets 6 and 7 about the axis 4 of the shaft 5. The purpose of the shifting means including the wheels 38 and the associated toothed racks 39 is to conform the effective width of the apparatus to the width of the selected web 16 of textile or like material.

The brackets 6 and 7 support two winding or convoluting devices 13 and 15. The winding device 13 comprises two bolt holders 8, 10 which are respectively mounted on the brackets 6, 7 and are aligned with each other (the common axis of the bolt holders 8, 10 is shown at 12). The other winding device 15 comprises two aligned bolt holders 9, 11 which are respectively mounted on the brackets 6, 7 and whose common axis is shown at 14. The axis 14 is spaced apart from and is parallel with the axes 4 and 12. When the winding device 13 is operative to convolute the web 16 around a core 82 (see FIG. 5*a*), the winding device 15 is held in a position of readiness and its bolt holders 9, 11 are open so that they allow successive increments of the webs 16 to pass through the winding device 15. The inverse holds true when the winding device 15 is operative to wind the web 16 around a core 82.

Figure 4:
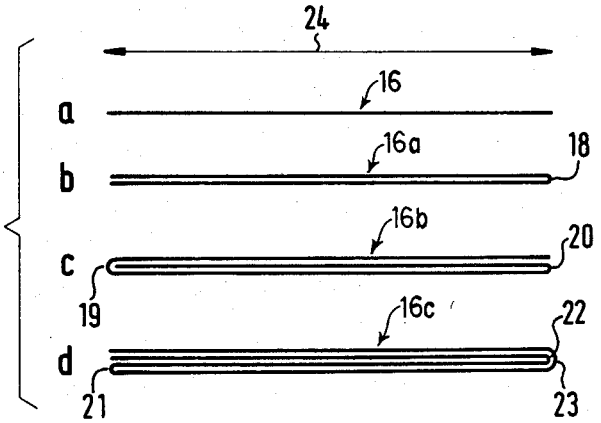
FIG. 4*a* is a schematic. transverse sectional view of a web which can be treated in the apparatus of FIGS. 1 to 3 and consists of a single layer of textile or other material.
FIG 4*b* is a schematic transverse sectional view of a second web which consists of two overlapping layers of textile or other material.
FIG. 4*c* is a similar schematic transverse sectional view of a web which consists of three overlapping layers.
FIG. 4*d* is a similar transverse sectional view of a further web which comprises four overlapping layers.

FIG. 4*a* shows that the web 16 can consist of a single layer of textile or other material. FIG. 4*b* illustrates a web 16*a* which consists of two overlapping layers; such layers are obtained by folding the relatively wide web 16*a* along a line 18 which extends substantially or exactly midway between the marginal portions of the web 16*a*. The web 16*b* of FIG. 4*c* consists of three overlapping layers which are obtained by folding the web along two parallel lines 19 and 20 which are preferably equidistant from one another and from the nearer marginal portions of the web 16*b*. FIG. 4*d*, finally, shows a web 16*c* which is twice as wide as the web 16*a* and is folded along three longitudinally extending lines 21, 22, 23 which are equidistant from one another and from the adjacent marginal portions of the web 16*c*. Other modes of folding a relatively wide web to obtain a multi-layer web can be resorted to in order to prepare the web for winding around cores 82. The length of the arrow 24 above FIG. 4*a* denotes the normal or average width of bolts 25 of cloth or the like which can be obtained in the apparatus of the present invention. As mentioned above, the brackets 6 and 7 are movable toward or away from each other to thus ensure that the apparatus can wind relatively wide or relatively narrow webs with the same degree of accuracy and predictability. The following part of the description will deal with the conversion of a discontinuously running single-layer web 16 into a succession of bolts 25 (see FIG. 5*a*).

The web 16 is supplied by a making or processing machine 17 (FIG. 5*a*) or another suitable source and is tensioned in the region between the machine 17 and the brackets 6, 7 so that it does not exhibit any transversely extending folds. The web is normally devoid of longitudinally extending folds, and the winding operation is carried out in such a way that the conversion of successive lengths of the web 16 into a succession of bolts 25 does not entail the development of any folds or any additional folds and/or similar irregularities.

Each of the four bolt holders 8, 9, 10, 11 is driven by a discrete prime mover 43, 42, 41, 40 (see FIGS. 2 and 3). Each such prime mover can constitute an electric motor. The prime movers 43, 42 for the bolt holders 8, 9 are mounted on the bracket 6, and the prime movers 41, 40 for the bolt holders 10, 11 are mounted on the bracket 7. The bolt holders 8, 9, 10, 11 respectively comprise bolt-engaging portions or winding heads 44, 45, 46, 47. The winding heads 44, 46 of the respective bolt holders 8, 10 are rotatable about the axis 12, and the winding heads 45, 47 of the respective bolt holders 9, 11 are rotatable about the axis 14. Each of the winding heads 44–47 is rotatable and movable axially with reference to the other parts of the respective bolt holder. The means for moving the winding heads 44–47 axially (i.e., in the direction of the axis 12 or 14) comprises four discrete fluid-operated motors in the form of double-acting hydraulic cylinder and piston units 50, 51, 52 and 53. The motors 50, 51 are mounted on the bracket 6, and the motors 52, 53 are mounted on the bracket 7 (see FIG. 1). The axes of the motors 50–53 are parallel to the axes 12, 14. Each of the motors 50–53 can comprise a motion transmitting yoke 56 (see the right-hand portions of FIGS. 1 and 2) which is attached to and can reciprocate a rod-like motion receiving member 57 of the corresponding winding head 44, 45, 46 or 47.

The bolt holders 8, 9 on the bracket 6 are mirror symmetrical to the associated bolt holders 10, 11 on the bracket 7 with reference to a vertical plane 58 which is disposed midway between the bearings 2, 3 for the shaft 5. Also, the construction of the bolt holder 8 is identical with that of the bolt holder 9, 10 or 11. The bolt holders 8, 10 of the winding device 13 are driven in synchronism, and the same holds true for the bolt holders 9, 11 of the winding device 15. The provision of discrete synchronizing means is desirable and advantageous but not absolutely necessary. The means for synchronizing the movements of the bolt holders 9, 11 comprises a shaft 60 whose end portions are rotatably journalled in the brackets 6, 7 so that the axis of this shaft is parallel to the common axis 14 of the bolt holders 9, 11. These bolt holders are connected with the synchronizing shaft 60 in such a way that they cannot rotate with reference thereto. The means for synchronizing the rotary movements of the bolt holders 8, 10 comprises a second synchronizing shaft 61 which is parallel to the axis 12 and is journalled in the brackets 6 and 7, the same as the shaft 60. The shafts 60 and 61 are shown in FIG. 1.

FIG. 2 shows that a gear 35 which is driven by the prime mover 41 meshes with a gear 36 of the bolt holder 10. The gear 35 is also in mesh with an intermediate gear 37 which is non-rotatably but axially movably mounted on the synchronizing shaft 61. The latter compels the bolt holder 8 of the corresponding winding device 13 to share the movements of the bolt holder 10. To this end, the shaft 61 carries a second intermediate gear 114 which corresponds to the intermediate gear 37 and meshes with the gear 115 of the prime mover 43 for the bolt holder 8. The manner of synchronizing the rotary movements of bolt holders 9 and 11, which form part of the winding device 15, through the medium of the shaft 60 is the same. The length of the synchronizing shafts 60, 61 at least matches the maximum contemplated distance between the brackets 6 and 7. These brackets are movable relative to the couplings shaft 60 and 61 in order to change the distance between the bolt holders 8, 9 and 10, 11.

Figure 14:
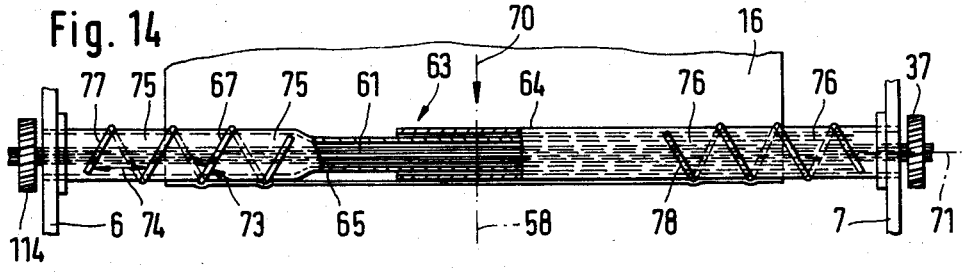
FIG. 14 is an enlarged partly elevational and partly sectional view of a web deflecting device which can be utilized in the improved apparatus.

The shafts 60, 61 are parallel with two elongated web deflecting devices 62 and 63. The purpose of the web deflecting device 63 is to deflect a web 16 coming from the source 17 toward the winding device 13 (see FIG. 5*a*), and the purpose of the deflecting device 62 is to direct the web 16 toward the winding device 15 (see FIG. 5*c*) when the latter is in the process of accumulating a bolt 25. The deflecting device 63 is preferably identical with the deflecting device 62, and its construction is illustrated in FIG. 14. This device comprises two elongated tubular components 64, 65 the latter of which is telescoped into the former. The tubular components 64, 65 are respectively secured to the brackets 7, 6 so that the effective length of the deflecting device 63 varies in automatic response to movement of the bracket 6 and/or 7 relative to the bracket 7 and/or 6. That portion of the tubular component 65 which does not enter the tubular component 64 is provided with a first group of external protuberances in the form of inclined ribs 67, and the corresponding portion of the external surface of the tubular component 64 is provided with a second group of similar external protuberances or ribs which slope in the opposite direction with reference to the plane 58. The two groups of ribs 67 are mirror symmetrical to one another with reference to the plane 58 and together form two spirals 77, 78 whose purpose is to tend to spread the web 16, i.e., to increase the width of the web while the latter advances toward the winding device 13. The direction in which the web 16 is pulled by the winding device 13 is indicated by the arrow 70. The width 73 of each rib 67 is preferably less than ten percent of the width 74 of spaces 75 (ribs of the tubular component 65) and 76 (ribs of the tubular component 64) between neighboring convolutions of the spirals 77 and 78. The commcn axis of the tubular components 64, 65 is shown at 71.

The web deflecting device 62 and/or 63 can be replaced with a much simpler deflecting device, e.g., with a simple elongated rail whose external surface has a convex portion coming into actual contact with the web 16 when the respective winding device collects the web 16 coming from the source 17 and passing through the then inactive winding device. The convex portion of the external surface of such simplified deflecting device or rail should extend along an arc corresponding to the maximum area of contact between the rail and the running web. The extent of contact between the peripheral surfaces of the tubular components 64, 65 of the deflecting device 63 and the web 16 (when the web is convoluted onto the winding device 13) is shown at 79 (see FIG. 5*a*). The convex peripheral surface of a deflecting device in the form of a rail or the like may but need not be provided with ribs 67 or analogous web spreading means.

In the apparatus which is shown in FIGS. 1–9 and 14 of the drawing, the components 64, 65 of the deflecting device 63 are not rotatable about the axis 71. However, it is equally within the purview of the invention to employ rotatable deflecting devices, e.g., deflecting devices which are rotated by the running web 16 or deflecting devices which receive torque from the prime movers for the respective bolt holders.

Figure 5A:
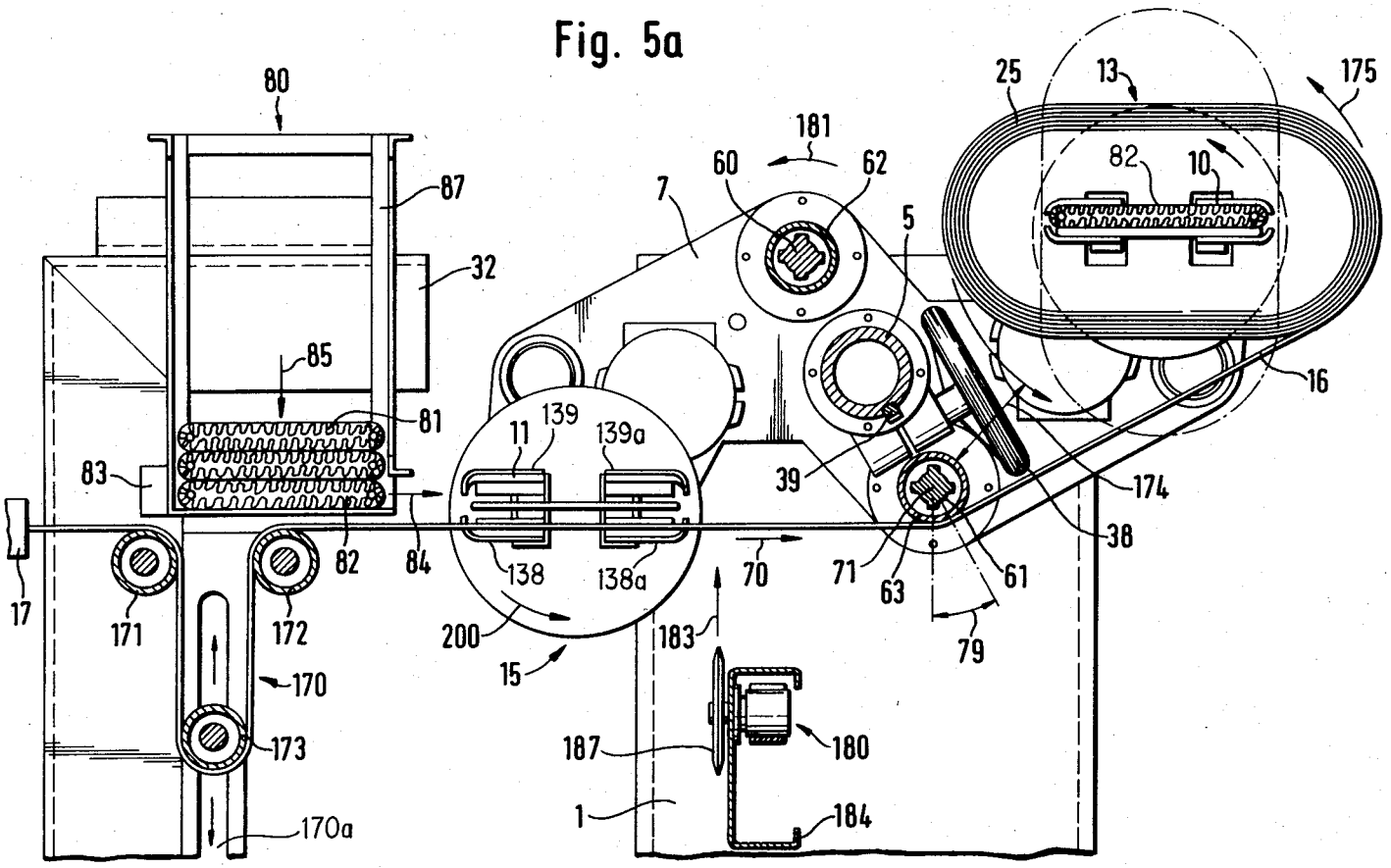
FIG. 5*a* is an enlarged view of the structure shown in the upper part of FIG. 3 substantially as seen in the direction of arrows from the line 5—5 of FIG. 2 and illustrates the last stage of forming a bolt on one of the winding devices while the other winding device is held in a position of readiness.
Figure 5B:
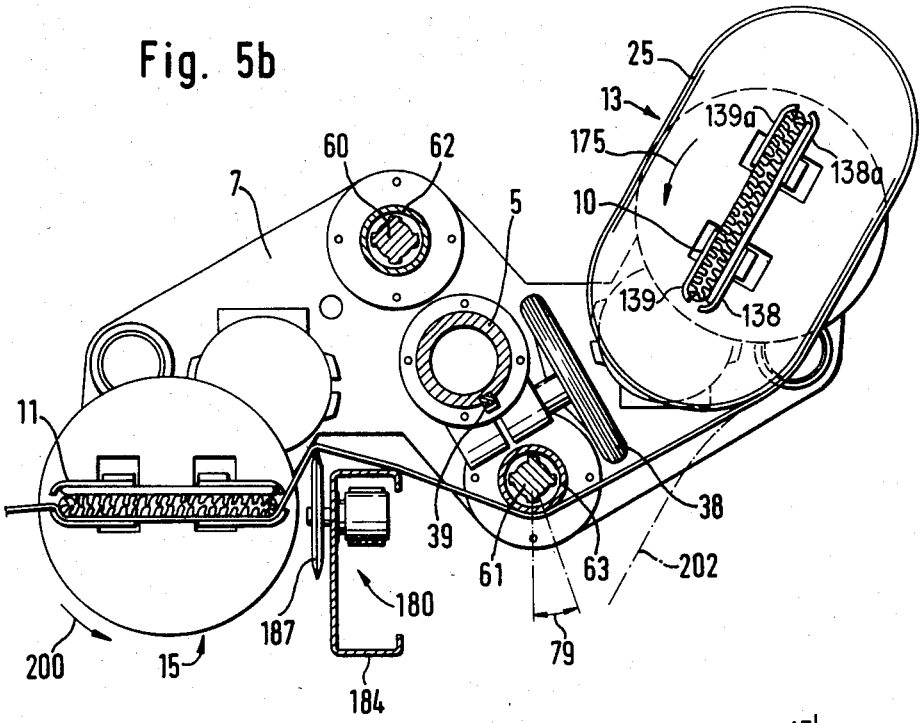
FIG. 5*b* illustrates some of the structure which is shown in FIG. 5*a* during a first stage of indexing of the support for the winding devices upon completion of the making of a bolt on one of the winding devices.
Figure 5C:
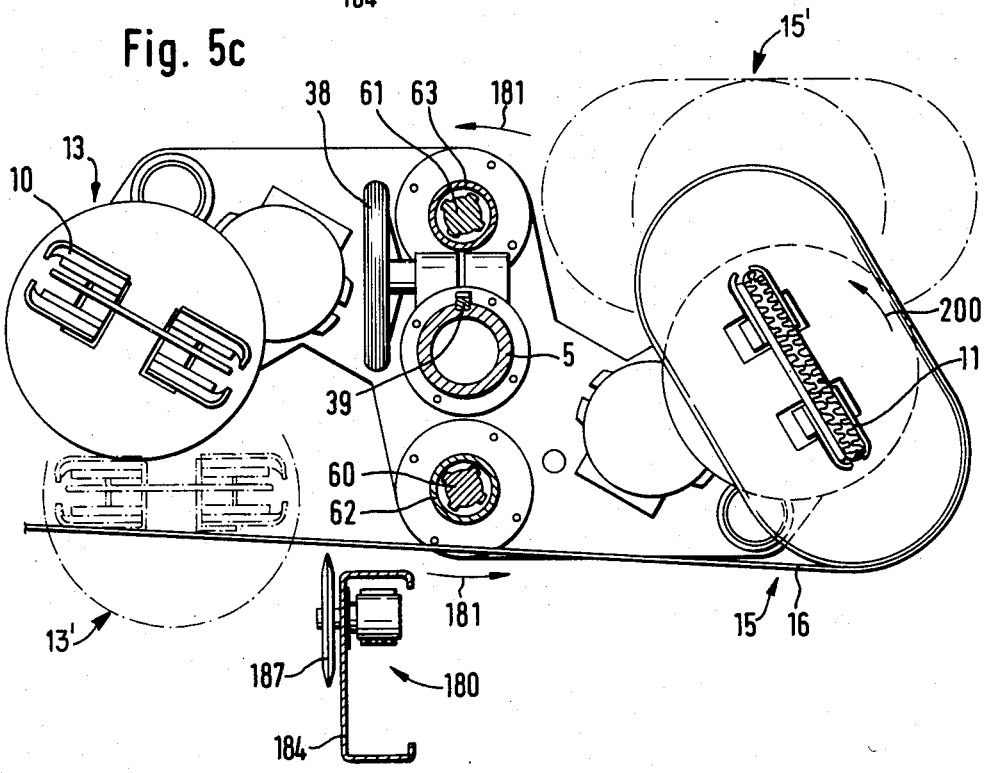
FIG. 5*c* illustrates the structure of FIG. 5*b* during a further stage of indexing of the support, the final positions of the two winding devices upon completion of the indexing operation being indicated by broken lines.

FIG. 5*a* shows the positions of the winding device 13 and the associated deflecting device 63 with reference to each other and with reference to the shaft 5. The arrangement is such that the deflecting device 63 is located upstream of the winding device 13, as considered in the direction (arrow 70) of travel of the running web 16 from the source 17 toward the bolt holders 8, 10 of the winding device 13. Moreover, the deflecting device 63 is rather closely adjacent to the winding device 13 but the mutual spacing of these devices is such that the growing or fully grown bolt 25 on the bolt holders 8, 10 cannot strike against the tubular components 64, 65 of the deflecting device 13 while the latter is driven to accumulate a bolt 25 or while the fully grown bolt 25 continues to rotate about the common axis 12 of the bolt holders 8 and 10. Since the bolt 25 is accumulated on a flat strip-shaped core 82, it has a substantially oval (rather than circular) cross-sectional outline. As shown in FIG. 5*a*, the distance 174 between the outermost layer of the fully grown bolt 25 on the winding device 13 and the corresponding deflecting device 63 suffices to ensure that the fully grown bolt 25 remains out of contact with the deflecting device 63 irrespective of the angular position of the device 13 relative to the shaft 5. The angle 79 of contact between the convex (cylindrical) peripheral surfaces of the tubular components 64, 65 of the deflecting device 63 and the running web 16 is preferably selected in such a way that this angle is not less than 10 degrees irrespective of the dimensions of the bolt 25 on the winding device 13. This is desirable and advantageous because the web 16 is much less likely to flutter during travel from the source 17 toward the winding device 13, i.e., the web is not likely to move away from and out of contact with the tubular components 64, 65 of the deflecting device 63. It will be readily appreciated that that angle 79 is greater when the bolt 25 begins to grow on the winding device 13 and that such angle decreases proportionally with the growth of the bolt 25 on the holders 8, 10.

FIG. 5*a* further shows that, when the web 16 is collected by the winding device 13, the web contacts only the deflecting device 63 and the parts of the winding device 13 but is out of contact with the (then idle) winding device 15 and/or deflecting device 62. The arrangement is preferably such that the winding device 13 and/or 15 need not cooperate with a biasing device (such as a roller) which is used in many conventional winding or convoluting apparatus and serves to bear against the outermost convolution or layer of the growing bolt. It has been found that such biasing means promotes the development of folds in the convoluted material of the bolts.

The apparatus further comprises a magazine 80 or an analogous source of supply of flat strip-shaped cores 81. FIG. 5*a* shows that the magazine 80 is adjacent to and is disposed at a level above the path of movement of the web 16 from the source 17 toward the space between the brackets 6, 7. The magazine 80 can be mounted on the frame 1 or on a discrete support and contains a stack of superimposed horizontal cores 81. Fresh cores can be admitted in the direction of arrow 85. The lowermost core 82 of the stack of cores 81 in the magazine 80 can be expelled by a transferring device 83 which is adjacent to the bottom wall of the magazine opposite an outlet opening which is provided in one of the upright sidewalls of the magazine and serves to permit expulsion of successive lowermost cores 82 into the range of the winding device 13 or 15, namely, into the range of the momentarily idle winding device. The direction of expulsion of successive lowermost cores 82 is indicated by the arrow 84. The width of the magazine 80 (as considered at right angles to the plane of FIG. 5*a*) is preferably adjustable so that this magazine can store stacks of relatively short or longer flat strip-shaped cores 81, depending on the selected distance between the brackets 6, 7 (namely, on the width of the web 16 which is supplied by the source 17).

The arrangement is such that the transferring device 83 deposits a core 82 on a portion of the web 16 while the web is idle. The freshly expelled core 82 comes to rest on the web 16 in the space between the bolt holders 9, 11 of the winding device 15 of FIG. 5*a* because the device 15 is in a position of readiness to begin with the accumulation of a fresh bolt 25.

FIG. 2 shows the shiftable or adjustable end walls 86, 87 of the magazine 80. These end walls are respectively movable in parallelism with the axis 4 of the shaft 5 by carriages 31 and 32. The carriage 31 is movable along an elongated rod-shaped guide member 91 (FIG. 1) by a feed screw 90 which is rotatable by a crank 26 or the like. The guide member 91 and the feed screw 90 are mounted in the platens 28, 92 of the frame 1. The mounting of the carriage 32 for the other end wall 87 of the magazine 80 is analogous to that of the carriage 31; FIG. 1 shows a crank 27 which can rotate a feed screw 88 serving to move the carriage 32 along an elongated rod-like guide member 89.

The apparatus also comprises a severing unit 180 which is mounted at a level below the path of movement of the web 16 from the source 17 toward the deflecting device 62 or 63. The severing unit 180 is mounted on a horizontal crossbeam 184 which is movable relative to the frame 1 up and down, namely, toward and away from the path of the web 16. The means for moving the crossbeam 184, and hence the severing unit 180, up (arrow 183 in FIG. 5*a*) and down comprises two fluid-operated (e.g., hydraulic) motors 185, 186 which are shown in FIG. 1 below the bearings 2, 3 for the shaft 5.

The severing unit 180 comprises a set of rotary disc-shaped knives 187 each of which has a polygonal outline and a peripheral cutting edge. Such cutting edges together constitute a composite cutting edge (denoted by the line 188 in the lower part of FIG. 1) having a length at least matching the width of the widest web 16 which is or can be treated in the improved apparatus. FIGS. 1 and 5*a* illustrate the severing unit 180 in its lower end position in which the knives 187 are disposed well below the path of travel of the web 16 from the source 17 toward the deflecting device 62 or 63. If the unit 180 is to sever the web 16 (e.g., when the winding device 13 of FIG. 5*a* carries a fully grown bolt 25), the motors 185, 186 are actuated to lift the crossbeam 184 so that the knives 187 sever the web between the winding device 15 and the deflecting device 63 of FIG. 5*a*. The arrangement is preferably such that the plane in which the knives 187 sever the web 16 is closely or immediately adjacent to the winding device 15, i.e., to the idle winding device. The knives 187 are driven by a motor 182 which is mounted on the mobile crossbeam 184.

Figure 6A:
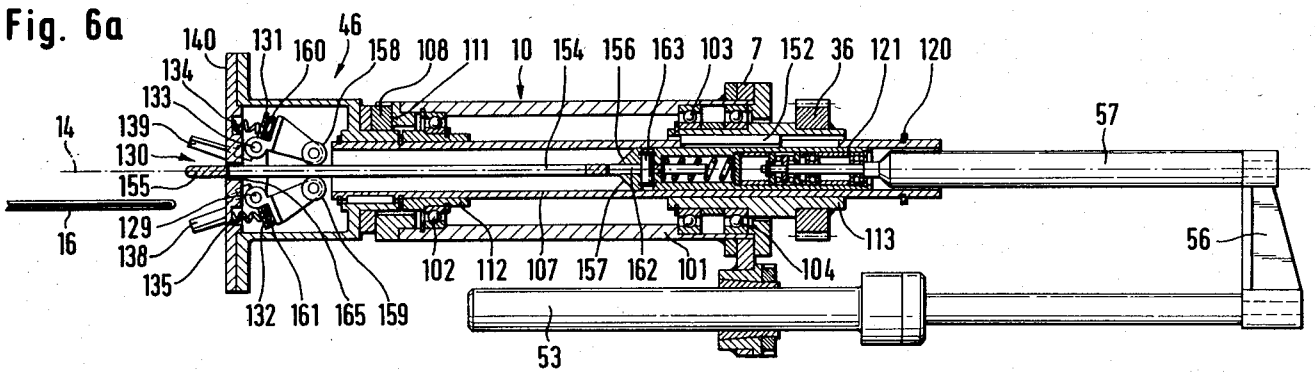
FIG. 6*a* is an enlarged sectional view of one of the four bolt holders substantially as seen in the direction of arrows from the line 6—6 of FIG. 2, the winding head of the bolt holder being shown in retracted position and the jaws of its tongs being shown in open positions.
Figure 6B:
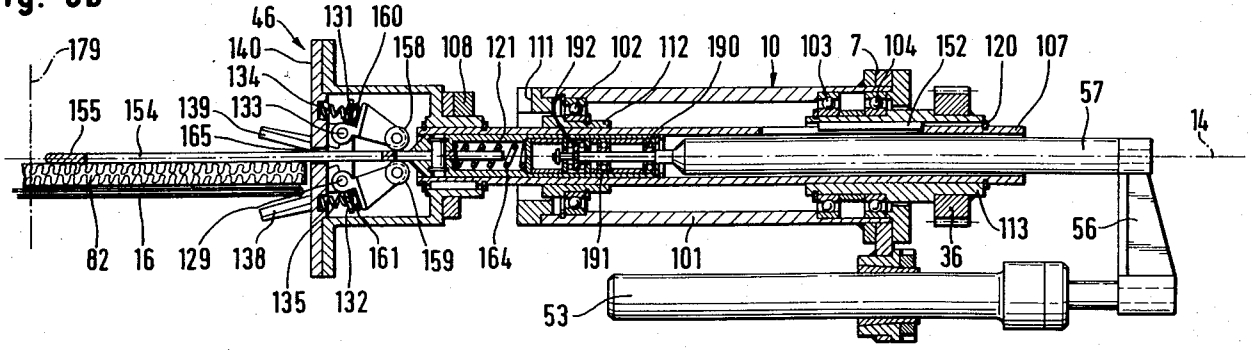
FIG. 6*b* illustrates the structure of FIG. 6*a* but with the winding head in extended position.
Figure 6C:
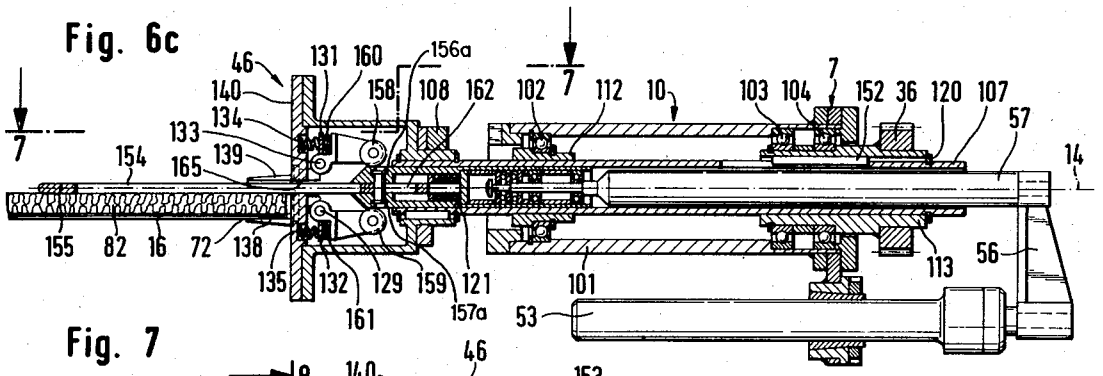
FIG. 6*c* illustrates the structure of FIG. 6*b* with the jaws of the tongs in closed positions to engage and hold one marginal portion of the web as well as one end portion of an elongated flat strip-shaped core for the bolt.
Figure 7:
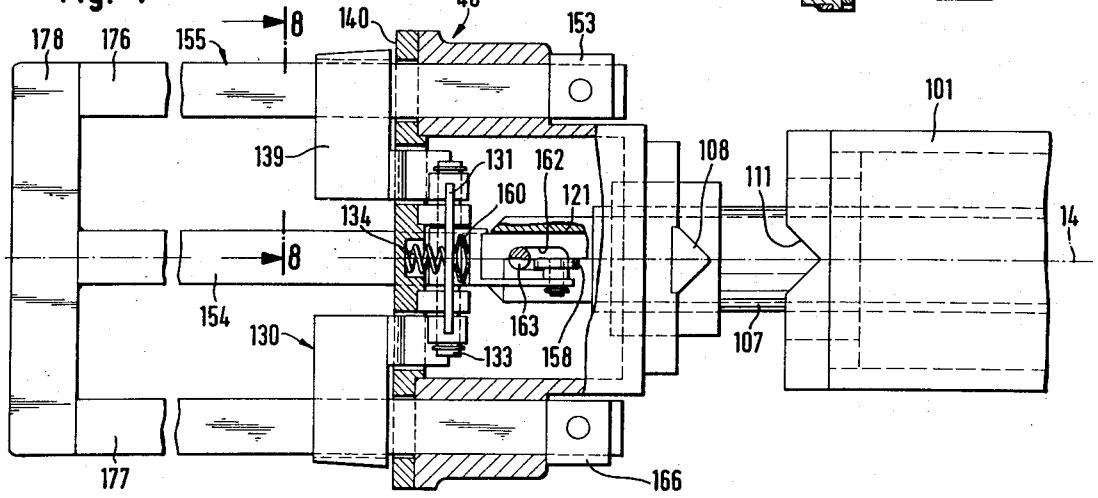
FIG. 7 is a fragmentary enlarged partial plan and partial sectional view substantially as seen in the direction of arrows from the line 7—7 of FIG. 6*c;*
Figure 9:
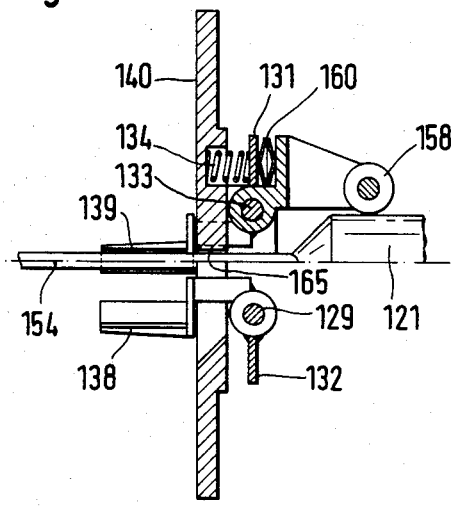
FIG. 9 is a sectional view as seen in the direction of arrows from the line 9—9 of FIG. 8.

As mentioned above, the bolt holders 8, 9, 10 and 11 are of identical design. A presently preferred construction of one of these bolt holders is shown in FIGS. 6*a*, 6*b* and 6*c* which show the bolt holder 10. The latter comprises a housing 101 which is mounted on the bracket 7 and surrounds a portion of a motion transmitting sleeve 113 rotatable in antifriction ball bearings 103, 104. The housing 101 further surrounds a bearing sleeve 112 which is surrounded by an antifriction ball bearing 102. The sleeves 112, 113 can rotate in but cannot move axially relative to the housing 101. They guide an axially movable hollow bearing member 107 in the form of a pipe which is held against rotation in the sleeves 112, 113 by a key 152 of the sleeve 113. Thus, when the sleeve 113 rotates in the housing 101, the key 152 compels the pipe 107 to share all angular movements of this sleeve. The sleeve 113 is driven by the aforementioned gear 36 which receives torque from the gear 35 of the prime mover 41 for the bolt holder 10. The pipe 107 confines a coupling element 121 which is slidable therein in the direction of the axis 14 and the front end portion of which is connected with a flat bar-like carrier 154 of a substantially U-shaped flat biasing device 155 (see also FIG. 7). The carrier 154 extends into and through a complementary slot of the coupling element 121 so that the latter cannot rotate relative to the biasing device 155 and vice versa. The right-hand or rear end portion of the carrier 154 (as viewed in FIGS. *6a* to *6c*) is biased by a coil spring 164. The extent of axial movement of the carrier 154 relative to the coupling element 121 is limited by a pin or post 163 which extends through an elongated slot 162 of the carrier 154. The pin 163 is mounted in or forms part of the coupling element 121. The means for preventing rotation of the carrier 154 further comprises a complementary slot 165 in front wall 140 of the corresponding winding head 46. The motion receiving member 57 has a smaller-diameter front end portion which extends into the coupling element 121 and is mounted therein in antifriction ball bearings 190, 191. The coupling element 121 shares all axial movements of the member 57.

The housing 101 further contains a thrust bearing 192 for the sleeve 112.

The winding head 46 is mounted on the forward end of the pipe 107. The retracted position of this winding head is shown in FIG. *6a*. This winding head has a rearwardly extending wedge-like projection or detent member 108 which is then received in a complementary socket 111 in the front end face of the housing 101 so that the winding head 46 is held against rotation about the axis 14. The detent means including the projection 108 and the socket 111 ensures that, when the winding head 46 is retracted to the position of FIG. *6a*, it invariably assumes a predetermined angular position with reference to the housing 101 of the bolt holder 10.

The winding head 46 can be rotated by the gear 36 through the medium of a friction clutch which latter is not specifically shown in the drawing. The provision of a friction clutch is desirable and advantageous in order to ensure that the motion transmitting connection between the prime mover 41 and the winding head 46 is not damaged when the projection 108 begins to enter the socket 111 of the housing 101. A suitable monitoring device (not shown) is provided to automatically arrest the prime mover 41 when the detent device for the head 46 is effective, i.e., when the projection 108 is fully received in the complementary socket 111.

Figure 8:
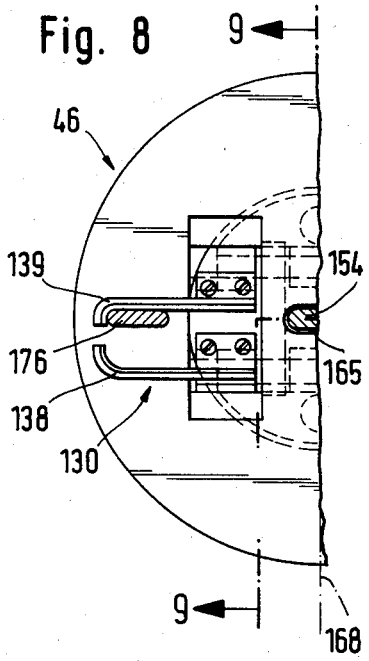
FIG. 8 is a fragmentary vertical sectional view as seen in the direction of arrows from the line 8—8 of FIG. 7.

The winding head 46 comprises a tongs 130 with four jaws of which only two (namely, the jaws 138 and 139) can be seen in FIGS. *6a*, *6b* and *6c*. The other two jaws 138*a*, 139*a* (see FIG. *5a*) are mirror symmetrical to the jaws 138, 139 with reference to a plane 168 which is shown in FIG. 8. When the tongs 130 is operative, the working or gripping surface of the jaw 138 and of the associated jaw 138*a* is located in a first plane, and the working or gripping surface of the jaw 139 and the associated jaw 139*a* is disposed in a second plane (see FIG. *6c*). When the projection 108 extends into the socket 111 of the housing 101, the angular positions of the jaws forming part of the then open tongs 130 are such that the web 16 can pass therebetween without touching the head 46. If the tongs 130 thereupon closes, its four jaws 138, 138*a*, 139, 139*a* (see FIG. *5b*) engage the respective sides of the web 16.

The means for opening and closing the jaws 138–139*a* of the tongs 130 comprises two actuating levers 131 (for the jaws 139, 139*a*) and 132 (for the jaws 138, 138*a*) which are respectively pivotable about the axes of two discrete parallel pintles 133, 129. FIGS. *6a* and *6b* show the tongs 130 in open position, and FIG. *6c* shows the tongs in closed position. The levers 131, 132 are biased by springs 134, 135 so that the roller followers 158, 159 which are mounted on their rear ends (remote from the wall 140) engage the respective sides of the retracted biasing member 155. The jaws 138–139*a* extend forwardly beyond the exposed side of the wall 140 and the positions of the jaws 138, 138*a* relative to the jaws 139, 139*a* are such that, when the tongs 130 is closed, the jaws 138, 138*a* engage the respective marginal portion 72 of the web 16 whereas the jaws 139, 139*a* engage the respective end of the core 82. The jaws 138, 138*a* then urge the web 16 against the core 82 and the jaws 139, 139*a* prevent the core 82 from yielding so that the web 16 is automatically wound onto and around the core 82 when the winding head 46 is set in rotary motion. Actually, the jaws 139, 139*a* engage the adjacent side of the biasing device 155 which then overlies the respective end portion of the core 82 (see FIGS. *6b* and *6c*).

In order to compensate for eventual deviations of the thickness of the cores 82 from a standard thickness and/or for fluctuations in the thickness of the web 16, each of the actuating levers 131, 132 can comprise two sections which are pivotable relative to each other (about the axis of the respective pintle 133, 129) and are biased apart by dished springs 160, 161.

The biasing member 155 serves to urge the core 82 against the web 16 and further comprises a web 178 (see FIG. 7) which extends transversely of and is secured to the front end portion of the carrier 154, and two legs 176, 177 which extend rearwardly from the respective end portions of the web 178. The parts 176, 177 and 178 of the biasing member 155 are preferably flat, and the forward stroke of the carrier 154 for the biasing member 155 is selected in such a way that the member 155 extends close to but not all the way to the central portion of the path of movement of the web 16 between the brackets 6 and 7. The central portion of such path is denoted by a phantom line 179 which is shown in FIG. *6b*. The wall 140 of the winding head 46 has elongated narrow slots into which the legs 176, 177 of the biasing member 155 extend so that they are adequately guided while the carrier 154 performs a forward or a return stroke.

In FIG. *6a*, the biasing member 155 is practically fully retracted into the housing 101 of the bolt holder 10, i.e., the coupling element 121 is held in a fully retracted position. The rear edge face of the web 178 of the biasing member 155 abuts against the outer side of the wall 140. During movement to such retracted position, the biasing member 55 entrains the wall 140 and thereby causes the projection 108 of the winding head 46 to penetrate into the socket 111 of the housing 101. The pipe 107 also shares such rearward movement of the biasing member 155. When the retraction of the biasing member 155 is completed, i.e., when the projection 108 extends into the socket 111, all parts of the bolt holder 10 are adjacent to the respective side of the path of movement of the web 16 toward the winding device 15. This is shown in FIG. *6a* which further shows that the jaws of the tongs 130 are open, i.e., the jaws 138, 138*a* are remote from the jaws 139, 139*a* and these jaws provide ample room for the respective end portion of the core 82, for the respective marginal portion 72 of the web 16 and for the biasing member 155.

The coupling element 121 is moved from the position of FIG. 6*a* toward the position of FIG. 6*b* in order to engage the tongs 130 with the web 16 and with the core 82. The biasing member 155 shares the forward movement of the coupling element 121 whereby the abutments 153, 166 at the rear ends of the legs 176, 177 of the biasing member 155 engage and entrain the winding head 46 in a direction to the left, as viewed in FIG. 6*a*, and cause the projection 108 to leave the socket 111 of the housing 101. Thus, the winding head 46 shares a certain portion of forward movement of the coupling element 121 and biasing member 155. The pipe 107 cannot move beyond the axial position which is shown in FIG. 6*b* because a collar 120 (see FIGS. 6*a*–6*c*) on the rear portion of this pipe then engages the adjacent end face of the sleeve 113. The biasing member 155 then extends beyond the wall 140 of the winding head 46 and is disposed in a plane which is parallel to the plane of the adjacent portion of the web 16. Furthermore, the biasing member 155 is disposed at a level above the core 82 which has been transferred (by 83) onto the web 16 so that one end portion of such core extends into the space between the opened upper jaws 139, 139*a* and the opened lower jaws 138, 138*a* of the tongs 130. The foremost portion of the biasing member 155 is closely adjacent but does not extend all the way to the aforementioned plane 179 which is disposed midway between the brackets 6, 7 and halves the web 16 between the wall 140 of the winding head 46 and the similar wall of the winding head 44 forming part of the bolt holder 8. The web 178 of the biasing member 155 is located forwardly of the jaws 139, 139*a* so that, when the tongs 130 closes, the jaws 139, 139*a* engage the adjacent portions of the respective legs 176, 177.

The coupling element 121 continues to move forwardly after the pipe 107 is arrested as a result of engagement between the collar 120 and the sleeve 113 whereby the carrier 154 of the biasing member 155 penetrates deeper into the coupling element 121 against the opposition of the spring 164. The extent of such movement of the coupling element 121 is determined by the length of the aforementioned elongated slot 162 which is provided in the carrier 154 and receives the pin 163 of the coupling element 121. The foremost position of the coupling element 121 is shown in FIG. 6*c*, i.e., the pin 163 is then received in the leftmost portion of the slot 162.

When the winding head 46 moves with the coupling element 121 and its projection 108 leaves the socket 111 of the housing 101, the head 46 is free to perform a rotary movement about the axis 14. Nevertheless, the angular position of the winding head 46 remains unchanged until after the tongs 130 closes so that its jaws 139, 139*a* bear against the upper sides of the legs 176, 177 and the jaws 138, 138*a* bear against the underside of the web 16 at a level below the core 82. Closing of the tongs 130 is effected in the following way:

The front end portion of the coupling element 121 is provided with suitably inclined cam faces 156, 157 which displace the roller followers 158, 159 on the actuating levers 131, 132 during the last stage of forward movement of the coupling element 121. The levers 131, 132 then pivot the respective jaws 139, 139*a* and 138, 138*a* against the opposition of the respective springs 134, 135 so that the tongs 130 is closed. The roller followers 158, 159 ultimately engage the side faces 156*a*, 157*a* of the coupling element 121, and such side faces are parallel to each other and to the axis 14 so that the tongs 130 remains closed as long as the roller followers 158, 159 remain in engagement with the respective side faces of the coupling element 121. In fact, the coupling element 121 then locks the tongs 130 in the closed position to prevent accidental movement of the jaws 138, 138*a* away from the jaws 139, 139*a*. Thus, the jaws 138, 138*a* cooperate with the jaws 139, 139*a* to urge the adjacent marginal portion 72 of the web 16 against the corresponding end portion of the core 82 as well as to urge the legs 176, 177 of the biasing member 155 against the upper side of the core 82, as viewed in FIG. 6*c*.

The winding head 46 is set in rotary motion (i.e., the gear 35 begins to drive the gear 36) only when the closing of the tongs 130 is completed, i.e., when the jaws of the tongs 130 assume the positions which are shown in FIG. 6*c*. When the gear 36 begins to rotate, it transmits torque to the sleeve 113, to the pipe 107, to the winding head 46, to the tongs 130 and to the biasing member 155. The member 57 and the housing 101 do not share the rotary movements of the sleeve 113.

The operation of the apparatus which is shown in FIGS. 1 to 9 and 14 is as follows:

The source 17 discharges successive increments of the web 16 which is assumed to consist of a single layer of textile material. However, and as described above in connection with FIGS. 4*b*, 4*c* and 4*d*, the source 17 can discharge a web 16*a*, 16*b* or 16*c* having two, three or four layers. If the web which issues from the source 17 has two or more layers, folding of such web (at 18 or 19, 20 or 21, 22, 23) is effected in or ahead of the source 17.

The path of the web 16 downstream of the source 17 extends through a tensioning unit 170 which is shown in the lower left-hand portion of FIG. 5*a* and includes two stationary guide rolls 171, 172 as well as a dancer roll 173 which is reciprocable in a vertical slot 170*a* of the frame 1 and rests on the web 16 so that the latter forms a loop in the space between the guide rolls 171 and 172. The dancer roll 173 carries one or more weights or is biased downwardly by one or more springs (not shown) to ensure that the web 16 between the rolls 171, 172 is subjected to requisite tension and is not likely to form transversely extending folds during winding onto the device 13 or 15. The tensioning device 170 compensates for eventual irregularities in transport of the web 16 from the source 17 toward the winding device 13 or 15.

The brackets 6 and 7 are assumed to dwell in the angular positions corresponding to that of the bracket 7 shown in FIG. 5*a*. Thus, the web 16 is wound onto the core 82 which is held by the winding device 13 so that it is converted into a growing bolt 25. Successive increments of the web 16 are deflected by the device 63 which is located upstream of the winding device 13. The web 16 is advanced (in the direction indicated by the arrow 70) by the rotating winding device 13 which is driven to rotate in a counterclockwise direction, as viewed in FIG. 5*a*. The other winding device 15 is idle and its tongs are open so that they allow the web 16 to advance between the upper jaws 139, 139*a* and the lower jaws 138, 138*a*. FIG. 5*a* merely shows the bolt holders 10 and 11; the other two bolt holders 8 and 9 are located in front of the plane of FIG. 5*a* and are respectively aligned with the bolt holders 10 and 11.

Successive increments of the web 16 which are tensioned by the unit 170 advance between the bolt holders 9, 11 of the winding device 13 preferably without coming into actual contact with any parts of the device 15 and thereupon engage the deflecting device 63 prior to reaching the outermost layer of the growing bolt 25 on the rotating winding device 13. As mentioned above, the angle 79 (namely, the extent to which the web 16 engages the tubular components 64, 65 of the deflecting device 63) is not less than 10 degrees, even when the bolt 25 on the winding device 13 is fully grown, in order to prevent fluttering of the web upstream of the winding station accommodating the device 13. Such fluttering could cause the web 16 to form longitudinally extending folds. The ribs 67 of the tubular components 64, 65 cause the web 16 to expand, i.e., to increase its width (if possible) and to thus eliminate eventual longitudinally extending folds in the material which is about to be convoluted onto the winding device 13. The bolt holders 8 and 10 of the winding device 13 rotate in the direction which is indicated by the arrows 175. A suitable sensor (not specifically shown) monitors the dimensions of the growing bolt 25 on the winding device 13 and can transmit a signal which is used to arrest the corresponding prime movers 43, 41. Such sensors are well known, for example, in cigarette making machines wherein the trailing end of an expiring roll of cigarette paper is spliced to the leading end of a fresh roll of cigarette paper as soon as the diameter of the expiring roll is reduced to a preselected value. The only difference is that the sensor which monitors the dimensions of the bolt 25 on the winding device 13 transmits a signal to arrest the prime movers 43, 41 when the bolt 25 is fully grown. The improved apparatus includes additional sensors and suitable control circuitry which processes the signals from various sensors and starts or arrests the corresponding prime movers or motors at desired intervals and in a desired sequence.

The source 17 ceases to discharge the web 16 as soon as the prime movers 43 and 41 are arrested so that the web 16 comes to a halt while the leader of its non-convoluted portion is still integrally connected with the outermost layer of the fully grown bolt 25 on the winding device 13. At the same time, the signal which has triggered stoppage of the motors 43, 41 and an interruption of transport of the web 16 from the source 17 can further actuate the transferring device 83 which is caused to advance the lowermost core 82 in the magazine 80 through the outlet of the magazine and onto the web 16 in the region between the bolt holders 9, 11 of the idle winding device 15. The tongs of winding heads 45, 47 of the bolt holders 9 and 11 are held in optimum angular positions for reception of the freshly expelled core 82 because the corresponding projections 108 are received in the respective sockets 111. A major surface of the flat core 82 rests on the upper side of the web 16 and the other major surface of such core is in an optimum position to be overlapped by the respective biasing members 155 in a manner as described in connection with FIGS. *6b* and *6c*.

The deposition of a core 82 on the web 16 in the space between the bolt holders 9 and 11 is followed by closing of the respective tongs in a manner as described in connection with FIGS. *6a* to *6c* so that the jaws of the tongs 130 forming part of the bolt holder 9 engage one marginal portion of the web 16 as well as the legs 176, 177 of the corresponding biasing member 155, and the jaws of the other tongs (forming part of the bolt holder 11) engage the other marginal portion of the web 16 as well as the legs 176, 177 of the corresponding biasing member 155. The biasing members 155 are disposed at a level above the path of the web 16 and serve to reinforce or stiffen the corresponding core 82. In fact, the cores 82 can be omitted altogether and the biasing members 155 can serve as temporary cores during the making of successive bolts 25. In other words, the cores 82 constitute a desirable but optional feature. The omission of such cores simplifies the construction of the apparatus because the magazine 80 and the transferring device 83 can be omitted. It is also possible to design the apparatus in such a way that it can but need not wind the web 16 onto cores 82.

When the web 16 is adequately clamped by the tongs 130 of the bolt holders 9 and 11 forming part of the winding device 15, the severing unit 180 is lifted (arrow 183) in the aforedescribed manner by the motors 185, 186 and the motor 182 is started to rotate the knives 187 so that the knives sever the web 16 immediately downstream of the winding device 15 and upstream of the deflecting device 63. The severing device 180 is returned to its inoperative (lower end) position and the motor 182 is arrested as soon as the severing operation is completed. If desired, the motor 182 is running as long as the apparatus is in use. This simplifies the controls of the apparatus.

When the severing operation is completed, the prime movers 40 and 42 are started to rotate the bolt holders 11 and 9 of the winding device 15 in the direction which is indicated by the arrow 200 (FIG. *5a*). The prime movers 40, 42 are started simultaneously with the web transporting device of the source 17 so that the latter begins to discharge the web 16 in a direction toward the tensioning unit 170. Furthermore, the shaft 5 is indexed through 180 degrees in a counterclockwise direction (see the arrow 181 in FIG. *5a*) so that, when the indexing operation is completed, the winding device 15 occupies the position previously occupied by the winding device 13 and the latter takes the position of the winding device 15 shown in FIG. *5a*. FIGS. *5b* and *5c* illustrate two intermediate stages of indexing movement of the shaft 5 and brackets 6 and 7. The final positions of the winding devices 13 and 15 are respectively shown by broken lines (as at 13' and 15') in FIG. *5c*. It will be noted that the direction of rotation of the winding device 15 (arrow 200) is the same as that of the winding device 13 (arrow 175) as well as the direction (arrow 181) of indexing the shaft 5 for the brackets 6, 17 and the winding devices 13, 15. Such selection of the directions of rotation of the winding devices 13, 15 and of indexing the shaft 5 reduces the likelihood of development of folds in the web 16 during indexing of the shaft 5.

It is preferred to slowly rotate the winding head 13 in the direction of arrow 175 while the shaft 5 is indexed in the direction of arrow 181. This ensures that the entire trailing portion 202 of the severed length of the web 16 is convoluted onto the outermost layer of the fully grown bolt 25. Once the trailing portion 202 is fully convoluted onto the bolt 25 which is held by the bolt holders 8, 10 of the winding device 13, the tongs 130 of the bolt holders 8, 10 are caused to open by retraction of the respective coupling elements 121 so that the bolt 25 is free to descend by gravity. Such gravitational descent of the fully grown bolt is possible as soon as the tongs of the bolt holders 8, 10 reassume the open positions corresponding to that of the tongs 130 shown in FIG. *6a*. The tongs 130 of the bolt holders 8, 10 then remain in their open positions while the winding device 13 dwells in the position of readiness (see the position 15' in FIG. 5*c*) and permits the web 16 to advance toward the deflecting device 62 and thence to the winding device 15 which rotates to form a growing bolt 25 in the same way as described in connection with the making of a bolt on the winding device 13.

The tongs 130 of the bolt holders 9, 11 forming part of the winding device 15 which are held in the position of readiness (see FIG. 5*a*) are caused to move to their extended positions and to engage the respective marginal portions of the web 16 while the web is maintained in expanded or stretched condition by the ribs 67 of the deflecting device 63. At the same time, the tongs 130 of the bolt holders 9, 11 also engage the respective end portions of the core 82 on the web portion between such bolt holders (the core 82 is indirectly clamped through the medium of the corresponding biasing members 155) before the winding device 15 is set in rotary motion by starting the corresponding prime movers 42, 40. All this takes place before the severing unit 180 cuts the web 16 between the winding devices 13 and 15. It has been found that such mode of engaging the web with the bolt holders of the winding device which is held in the position of readiness ensures proper spreading of and the elimination of folds in the webs each of which constitutes a single layer as well as in the webs which consist of two or more overlapping layers.

Figure 11:
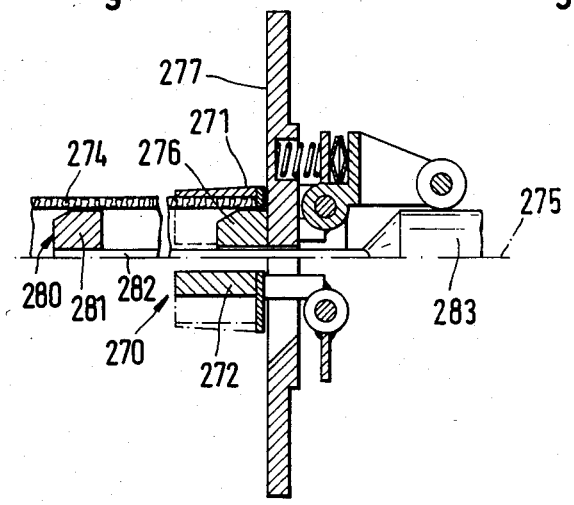
FIG. 11 is a sectional view as seen in the direction of arrows from the line 11—11 of FIG. 10.
Figure 10:
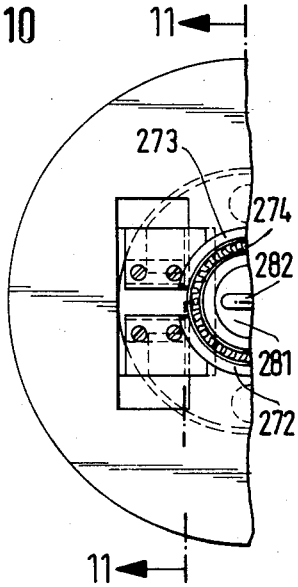
FIG. 10 is a view similar to that of FIG. 8 but showing a portion of a modified bolt holder.

It is further clear that the illustrated strip- or board-shaped cores 81 and 82 can be replaced with other types of cores. For example, the apparatus can comprise a magazine for rod-like or hollow cylindrical cores. It is then necessary to provide the bolt holders 8, 9, 10 and 11 with differently configurated tongs to engage the end portions of solid rod-shaped or hollow cylindrical cores. This is shown in FIGS. 10 and 11 wherein the illustrated bolt holder does not comprise an equivalent of the biasing member 155 and its tongs 270 comprises a pair of actuating levers 271, 272 each of which carries a single substantially semicircular jaw 273. The curvature of the internal surfaces of the jaws 273 conforms to that of the cylindrical external surface of the hollow cylindrical core 274. The biasing member 155 is replaced with a centrally located internal support 280 for the core 274. The support 280 includes an elongated rod-like carrier 282 the front end portion of which is connected with a cylindrical mandrel 281 which can be introduced into the interior of the adjacent end portion of the core 274. The rear end portion of the carrier 282 is connected to a coupling element 283 corresponding to the coupling element 121 of FIGS. 6*a*–6*c*. The wall 277 of the winding head which carries the tongs 270 of FIGS. 10 and 11 supports a second mandrel 276 which is also receivable in the adjacent end portion of a hollow cylindrical core 274 and whose axis 275 coincides with that of the mandrel 281. When the coupling element 283 is in the process of retracting the first or front mandrel 281, the latter engages the front side of the second mandrel 276 and extracts the mandrel 276 from the core 274 in substantially the same way as described in connection with the web 178 of the biasing member 155 shown in FIGS. 6*a* to 6*c*. The manner in which the winding head including the wall 277 is held against rotation in the retracted position is or can be the same as described in connection with FIGS. 6*a*–6*c*, i.e., this winding head can be provided with a projection which enters a complementary socket in the stationary housing of the corresponding bolt holder.

Figure 13:
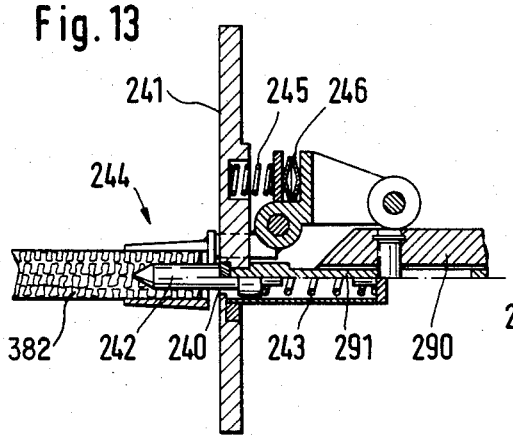
FIG. 13 is a sectional view as seen in the direction of arrows from the line 13—13 of FIG. 12.
Figure 12:
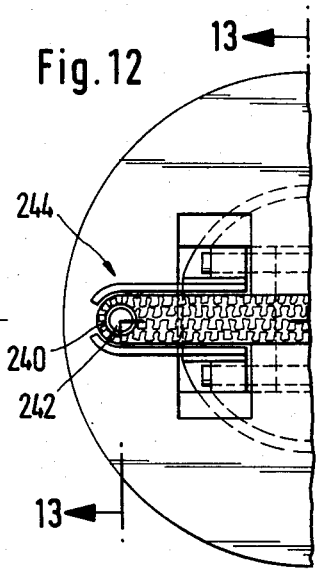
FIG. 12 is a view similar to that of FIG. 8 but showing a portion of a further bolt holder.

It is possible to modify the apparatus of FIGS. 1 to 9 and 14 by omitting the biasing members 155 if the cores are sufficiently stiff to be capable of resisting pronounced deformation in response to direct engagement with the jaws of the tongs. This is shown in FIGS. 12 and 13 which show a portion of a modified bolt holder. This bolt holder does not employ a biasing member and the narrow slots which are provided in the bolt holder of FIGS. 6*a*–6*c* for the legs 176, 177 of the biasing member 155 are replaced with round holes 240 for two discrete mandrels 242 whose axes extend in parallelism with the axis of the bolt holder. The holes 240 are provided in the wall 241 of the winding head and the mandrels 242 are reciprocable in the respective holes 240 and are biased by coil springs 243. In order to move the mandrels 242 to their retracted positions, such mandrels must overcome the resistance of the respective springs 243. The end faces of the flat strip-shaped core 382 are provided with blind bores which receive the corresponding mandrels 242. If the end faces of the core are not provided with such blind bores, the core simply pushes the respective mandrels 282 back into the interior of the winding head so that the mandrels are moved out of the way. The tongs 244 of FIGS. 12 and 13 is similar to or identical with the tongs 130 which is shown in FIGS. 6*a*–6*c*. FIG. 13 merely shows one of the springs 245 which react against the wall 241 of the winding head and urge the respective jaws to open positions, and one of the dished springs 246 each of which is disposed between the two sections of the respective actuating lever.

In order to ensure that the winding head which includes the wall 241 can move axially in spite of the absence of a biasing member, the front portion of the coupling element 290 (which is a functional equivalent of the coupling element 121 shown in FIGS. 6*a*–6*c*) guides a carrier 291 which is reciprocable therein and is connected to the winding head including the wall 241. The extent to which the carrier 291 is reciprocable with reference to the coupling element 290 is limited in the same way as described for the coupling element 121 and carrier 154 of FIGS. 6*a*–6*c*, i.e., the carrier 291 has an elongated slot which receives a pin of the coupling element 290.

Figure 15:
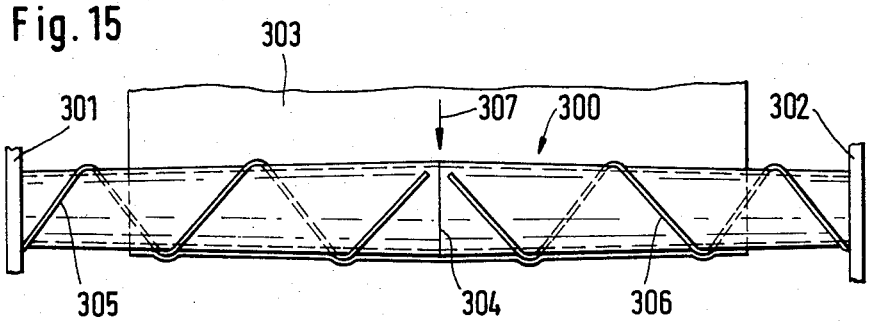
FIG. 15 is an elevational view of a modified web deflecting device.

Referring finally to FIG. 15, there is shown a modified deflecting device 300 which can be utilized in lieu of the deflecting device 62 or 63. The deflecting device 300 can be used with advantage in apparatus wherein the brackets for the bolt holders are mounted at a fixed distance from one another. The end portions of the deflecting device 300 are secured to the two fixedly mounted (but indexible) brackets 301, 302 corresponding to the brackets 6, 7 of FIGS. 1 to 3, and its convex (cylindrical) peripheral surface is in contact with the web 303. The diameter of the deflecting device 300 increases somewhat in directions from the brackets 301, 302 toward the center, namely, toward a plane 304 which is disposed midway between the marginal portions of the web 303. The latter is advanced in the direction which is indicated by the arrow 307. The two substantially frustoconical halves of the deflecting device 300 are mirror symmetrical to one another with reference to the plane 304 and are respectively provided with spiral ribs 305, 306 which are also mirror symmetrical to each other with reference to the plane 304. These ribs effect a spreading of the running web 303 so that they eliminate eventual longitudinally extending folds in the material of the web. The ribs 305 and 306 are inclined outwardly and away from the plane 304, as considered in the direction of the arrow 307. This ensures that such ribs can perform a highly satisfactory spreading or flattening action by tending to increase the width of the running web 303.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for converting a running web into a series of discrete bolts, comprising a source of running web; a support indexible about a fixed axis between first and second positions at 180° with reference to one another; first and second winding devices and first and second deflecting devices mounted on and indexible with said support so that said first winding device assumes an operative position in the first position of said support and receives from said source successive increments of the running web which is maintained in a predetermined path by the first deflecting device while said second winding device and the second deflecting device assume positions of readiness and the second winding device assumes an operative position in the second position of said support and receives from said source successive increments of the running web which is maintained in said predetermined path by said second deflecting device while said first winding device and said first deflecting device assume positions of readiness, said path extending through that winding device which is held in said position of readiness; and means for severing the web intermediate said winding devices upon completed conversion of a length of web into a bolt on the winding device which is held in the operative position, said winding devices being rotatable about axes which are parallel to said fixed axis and each thereof comprising a pair of coaxial rotary bolt holders disposed at the opposite sides of said path and having tongs movable axially with portions of the corresponding bolt holders between retracted positions of disengagement from and extended positions of engagement with the adjacent marginal portions of the web in said path, each of said bolt holders further comprising detent means arranged to maintain the respective tongs in a predetermined angular position in the retracted position of the tongs.

2. The apparatus of claim 1, further comprising a discrete prime mover for each of said bolt holders, said prime movers being arranged to rotate the bolt holders about the respective axes and further comprising means for synchronizing the movements of the bolt holders of each of said winding devices, said support including two spaced-apart brackets each of which supports one bolt holder of each of said winding devices and the corresponding prime mover.

3. The apparatus of claim 1, wherein each of said bolt holders comprises a housing on said support and said portion of each of said bolt holders comprises a winding head supporting the respective tongs, said winding heads being rotatable about the axes of the respective winding devices and being movable axially with reference to the corresponding housings between said retracted and extended positions, each of said winding heads including a wall adjacent to the respective side of said path and each of said tongs having jaws extending beyond the respective wall toward said path, each of said winding heads further including spring-biased actuating means for closing and opening the jaws of the respective tongs when said winding heads respectively assume said extended and retracted positions.

4. The apparatus of claim 3, wherein each of said bolt holders further comprises an elongated hollow bearing member having an end portion connected with the corresponding winding head and being rotatable about the axis of the respective winding device as well as movable axially relative to the support, a coupling element rotatably and axially movably mounted in the respective bearing member, motor means for moving the bearing member axially with reference to the support, and a spring-loaded biasing member including a carrier longitudinally movably but non-rotatably connected with said coupling element, each of said coupling elements having cam means arranged to close the respective tongs in response to axial movement of such coupling element toward said path.

5. The apparatus of claim 3, further comprising means for supplying cores between the bolt holders of the winding device which is held in said position of readiness, each of said bolt holders further comprising a biasing member movable between an operative position adjacent to one side of the core between the bolt holders of the respective winding device and an inoperative position, each of said tongs being arranged to urge the respective biasing member against the core in the operative position of the biasing member, the biasing members of each pair of coaxial bolt holders being mirror symmetrical to one another with reference to a plane which is disposed midway between the bolt holders of said winding devices and said biasing members overlying portions of said path in the operative positions thereof.

6. The apparatus of claim 5, wherein said biasing members include webs arranged to move the respective winding heads axially to said retracted positions in response to movement of the biasing members from said operative positions thereof, each of said biasing members further comprising a pair of legs reciprocable in the respective winding head and at least one of said legs having abutment means arranged to entrain the respective winding head to said extended position in response to movement of the biasing member to the operative position thereof.

7. The apparatus of claim 3, wherein each of said bolt holders further comprises a housing and wherein said detent means are arranged to hold the respective winding head in a predetermined angular position in response to movement of such winding head to the retracted position thereof, each of said tongs being maintained in a predetermined orientation with reference to the web in said path in the predetermined angular position of the respective winding head.

8. The apparatus of claim 1, wherein each of said deflecting devices has a convex web-contacting surface and web-spreading ribs provided on said surface, said ribs forming two groups of spaced-apart ribs disposed at the opposite sides of a plane extending midway between the bolt holders of said winding devices and the ribs of the two groups being inclined in opposite directions with reference to said plane, each of said ribs having a thickness which is less than ten percent of the mutual spacing of neighboring ribs in the respective group.

9. The apparatus of claim 1, further comprising a magazine for a supply of cores and means for transferring a core from the magazine onto the web portion extending between the bolt holders of the winding device in said position of readiness.

10. The apparatus of claim 1, wherein said support includes two spaced-apart brackets each arranged to support one bolt holder of each of said winding devices, and further comprising means for moving said brackets toward and away from one another axially of said winding devices, said deflecting devices being of variable length and having end portions secured to said brackets so that the length of each deflecting device changes in response to movement of said brackets relative to one another.

* * * * *